US005520778A

United States Patent [19]

Sawdai

[11] Patent Number: 5,520,778

[45] Date of Patent: May 28, 1996

[54] CELLULOSIC FIBROUS STRUCTURES HAVING PRESSURE DIFFERENTIAL INDUCED PROTUBERANCES AND A PROCESS OF MAKING SUCH CELLULOSIC FIBROUS STRUCTURES

[75] Inventor: Albert H. Sawdai, Cincinnati, Ohio

[73] Assignee: The Procter & Gamble Company, Cincinnati, Ohio

[21] Appl. No.: 288,528

[22] Filed: Aug. 9, 1994

Related U.S. Application Data

[62] Division of Ser. No. 130,536, Oct. 1, 1993, Pat. No. 5,366,785, which is a continuation of Ser. No. 800,804, Nov. 27, 1991, abandoned.

[51] Int. Cl.[6] ..... D21H 25/04

[52] U.S. Cl. ..... 162/115; 162/117; 162/206

[58] Field of Search ..... 162/109, 113, 162/115, 116, 111, 117, 221–227, 297, 206, 205, 204, 207; 428/152, 153

[56] References Cited

U.S. PATENT DOCUMENTS

| | | | |
|---|---|---|---|
| 2,940,891 | 6/1960 | Muller | 162/113 |
| 3,061,505 | 10/1962 | Helasti | 162/105 |
| 3,301,746 | 1/1967 | Sanford et al. | 162/113 |
| 3,414,459 | 12/1968 | Wells | 161/131 |
| 3,556,907 | 1/1971 | Nystrand | 156/470 |
| 3,867,225 | 1/1971 | Nystrand | 156/209 |
| 3,940,529 | 2/1976 | Hepford et al. | 428/178 |
| 3,961,119 | 6/1976 | Thomas | 428/178 |
| 4,075,382 | 2/1978 | Chapman et al. | 428/192 |
| 4,100,017 | 7/1978 | Flautt, Jr. | 162/111 |
| 4,297,404 | 10/1981 | Nguyen | 428/85 |
| 4,320,162 | 3/1982 | Schulz | 428/154 |
| 4,376,671 | 3/1983 | Schulz | 156/549 |
| 4,514,345 | 4/1985 | Johnson et al. | 264/22 |
| 4,637,859 | 1/1987 | Trokhan | 162/113 |
| 4,921,034 | 5/1990 | Burgess et al. | 162/109 |
| 4,994,144 | 2/1991 | Smith et al. | 162/111 |
| 5,126,015 | 6/1992 | Pounder | 162/206 |

FOREIGN PATENT DOCUMENTS

| | | |
|---|---|---|
| 0426288A2 | 5/1991 | European Pat. Off. . |
| WO94/08089 | 4/1994 | WIPO . |

*Primary Examiner*—Brenda A. Lamb

*Attorney, Agent, or Firm*—Larry L. Huston; Gerry S. Gressel; E. Kelly Linman

[57] ABSTRACT

Disclosed is a cellulosic fibrous structure, particularly a consumer product such as toilet tissue, facial tissue or a paper towel. In a first embodiment, extending outwardly from each face of the cellulosic fibrous structure is a plurality of protuberances. The protuberances extend bilaterally outwardly from the plane of the cellulosic fibrous structure in both directions. The bilaterally extending protuberances increase the caliper and texture of the consumer product embodied in the cellulosic fibrous structure. In a second embodiment, the protuberances extend outwardly, and are induced by fluid embossing, rather than mechanical embossing. Also disclosed is a fluid embossing process for making such cellulosic fibrous structures.

12 Claims, 2 Drawing Sheets

CELLULOSIC FIBROUS STRUCTURES HAVING PRESSURE DIFFERENTIAL INDUCED PROTUBERANCES AND A PROCESS OF MAKING SUCH CELLULOSIC FIBROUS STRUCTURES

This is a divisional of application Ser. No. 08/130,536, filed on Oct. 1, 1993 now U.S. Pat. No. 5,366,785, which is a file wrapper continuation application of Ser. No. 07/800,804 filed Nov. 27, 1991, now abandoned.

FIELD OF THE INVENTION

The present invention relates to cellulosic fibrous structures, and particularly to consumer products. More particularly, the present invention relates to cellulosic fibrous consumer products of which it may be desired to increase the caliper or texture.

BACKGROUND OF THE INVENTION

Cellulosic fibrous structures are commonly found in many consumer products. Cellulosic fibrous structures, such as toilet tissue, facial tissue and paper towels are a staple of daily life. Toilet tissue, facial tissue and paper towels are used throughout home and industry for a variety of purposes.

Several features of toilet tissue, facial tissue and paper towel consumer products are desired by, if not important to, the consumer. For example, the consumer frequently desires a cellulosic fibrous structure in the form of one of the aforementioned consumer products which has a relatively high caliper. The relatively high caliper imparts the appearance of strength and of a durable, high quality consumer product. Technically, a relatively greater caliper may favorably affect the appearance, cleaning ability, tactile impression and absorbency of the cellulosic fibrous structure. The caliper of a cellulosic fibrous structure may be increased according to a variety of methods known in the prior art. For example, the basis weight of the cellulosic fibrous structure may be increased, so that more cellulosic fibers are present per unit area. However, this method has several drawbacks. Particularly, a uniform distribution of a relatively larger quantity of the cellulosic fibers may not be the most efficient utilization of raw materials and, in fact may even represent a waste of, rather than merely poor economization of, the raw materials. Also, there now exists a current and growing emphasis on economizing renewable resources such as cellulosic pulp. Utilizing more fibers per unit area of a consumer product such as toilet tissue, facial tissue or paper towels is contrary to this growing public demand.

One way to overcome the aforementioned disadvantages of increasing caliper by simply increasing the basis weight of the cellulosic fibrous structure and still achieve an increase in caliper is to utilize a multi-ply structure. For example, U.S. Pat. No. 3,940,529 issued Feb. 24, 1976 to Hepford et al. discloses a sheet having two webs, each with crests and depressions. The crests and depressions of each web are registered so that the crests of each web are positioned between the crests of the other web, yet spaced from the depressions. The webs are joined at locations intermediate such crests and depressions. This arrangement provides an increase in caliper over that obtained by simply Joining two otherwise like webs of equivalent basis weight but not having crests and depressions. This increase is due to the void space intermediate the webs. However, this teaching requires careful positioning, arranging, and registering of the crests and depressions of each sheet so that the two webs are properly joined.

Similarly, commonly assigned U.S. Pat. No. 4,100,017 issued Jul. 11, 1978 to Flautt, Jr. discloses multi-ply tissue products having dissimilar webs. In this teaching a low density, high bulk web is united with a conventional web. This arrangement results in a laminate that is thicker and softer than that obtained by joining two identical webs. However, manufacturing complexity is increased by having dissimilar materials to stock and supply vis-a-vis utilizing the same materials throughout the multi-ply tissue product.

U.S. Pat. No. 4,320,162 issued Mar. 16, 1982 to Schulz and U.S. Pat. No. 4,376,671 issued Mar. 15, 1983 to Schulz disclose multi-ply sheets. Each ply is joined to the opposite ply at deep spot embossments. Between the deep spot embossments each ply has shallow secondary embossments which are offset from the shallow secondary embossments of the other ply. Both the deep and shallow embossments are oriented towards the center of the multi-ply sheet. These teachings suffer from the drawbacks that the deep and shallow embossments are inwardly oriented. If the embossments were oriented outwardly, and away from the center of the sheet, an increase in apparent caliper might possibly result, because the apexes of the embossments would be spaced further apart. Similarly, U.S. Pat. No. 3,556,907 issued Jan. 17, 1971 to Nystrand discloses an embossed laminate having two laminate with offset projecting embossments oriented towards the center of the laminate.

An enhancement of the teachings is found in U.S. Pat. No. 4,921,034 issued May 1, 1990 to Burgess et al. Burgess et al. discloses paper having up and down bosses formed across the mid-plane of the web. Each boss is asymmetric, with the up bosses having a different X-Y orientation than that of the down bosses.

However, the Hepford et al., Flautt, Jr., both Schulz, Nystrand, and Burgess et al. teachings suffer from the drawback that multiple ply consumer products are more complex, and hence more expensive to manufacture. Multiple ply products require an extra converting operation to join the two (or more) plies and additional warehousing and handling of matched parent rolls so that the resulting product does not consist of mismatched or incompatible plies.

One attempt involving single ply products which has been very commercially successful in overcoming certain disadvantages of the prior art is to utilize the drying section of the papermaking machine to enhance properties, such as caliper, of consumer products. Particularly, blow-through drying of the cellulosic fibrous structure—rather than press felt drying—can increase the caliper of the cellulosic fibrous structure. Blow-through drying may, at the same time, increase the tensile strength and burst strength of the cellulosic fibrous structure. Examples of consumer products made in this manner are illustrated in commonly assigned U.S. Pat. No. 4,637,859 issued Jan. 20, 1987 to Trokhan.

Another manner in which relatively high caliper may be attained without uneconomical use of the materials is by utilizing the forming section of the papermaking machine used to manufacture the cellulosic fibrous structure. For example, as illustrated in commonly assigned U.S. Pat. No. 4,514,345 issued Apr. 30, 1985 to Johnson et al., a forming belt having protuberances which displace a certain volume of the cellulosic fibers may be utilized. However, the resulting consumer product may have limited opacity in the regions where the fibers are displaced by the protuberances. Thus, using the same quantity of cellulosic fibers may result in a higher cal iper, lower opacity consumer product vis-a-vis a constant basis weight cellulosic fibrous structure.

Yet another well known way to increase the caliper of cellulosic fibrous structures is by mechanical embossing. In fact, mechanically embossed patterns are very common in cellulosic fibrous structures, and considerable efforts in the prior art have been directed to mechanically embossing cellulosic fibrous structures. As used herein, mechanical embossing refers to the application of force to the cellulosic fibrous structure through rigid members, such as protrusions on the periphery of rolls. One well known mechanically embossed pattern which appears in paper towel consumer products marketed by The Procter & Gamble Company, the assignee of the present invention, is illustrated in commonly assigned U.S. Pat. No. Des. 239,337 issued Mar. 9, 1976 to Appleman.

Mechanical embossing may be performed by either of two well known processes, nested embossing or knob-to-knob embossing. Nested embossing utilizes protrusions and depressions in axially synchronously rotated embossing rolls. This produces a like pattern of protrusions and depressions in the cellulosic fibrous structures produced thereby, as illustrated in U.S. Pat. No. 3,556,907 issued Jan. 19, 1971 to Nystrand and in U.S. Pat. No. 3,867,225 issued Feb. 18, 1975 to Nystrand.

In knob-to-knob embossing the protrusions of the mechanical embossing rolls are registered, producing a cellulosic fibrous structure having discrete sites in each of two laminate bonded together. Knob-to-knob embossing is illustrated in commonly assigned U.S. Pat. No. 3,414,459 issued Dec. 3, 1968 to Wells.

Either of these two mechanical embossing processes will produce one or more sites or regions of the cellulosic fibrous structure which is out of the plane of the balance or the background of the cellulosic fibrous structure. By having sites or regions of the cellulosic fibrous structure displaced from the plane of the balance or background of the cellulosic fibrous structure, differences in elevation, taken perpendicular to the plane of the cellulosic fibrous structure become apparent and the overall caliper is increased. Such increase does not require the utilization of more materials per unit area, because, generally, the basis weight remains generally constant in the embossed and nonembossed sites or regions of the cellulosic fibrous structure.

However, the mechanical embossing processes imparts caliper at the expense of other properties desired by the consumer. Particularly, mechanical embossing disrupts the bonds between fibers resulting in a cellulosic fibrous structure having less tensile strength, and possibly less softness, than existed before the mechanical embossing.

Another feature often desired in consumer products such as toilet tissue, facial tissue and paper towels is a particular surface texture. A surface texture can be functional, such as providing efficacious cleaning or scrubbing. A surface texture may also be aesthetic, imparting a more quilted or cloth-like appearance to the cellulosic fibrous structure.

A particular surface texture may be imparted by mechanical embossing, as discussed above. However, imparting a surface texture by the mechanical embossing processes results in a cellulosic fibrous structure having the aforementioned drawbacks.

Surface texture may also be influenced by having high basis weight and low basis weight regions present within the cellulosic fibrous structure as described relative to the aforementioned Johnson et al. patent. However, not all forming sections of papermaking machines are able to accommodate multiple basis weight cellulosic fibrous structures when manufacturing consumer products.

It is thus apparent that none of the foregoing prior art provides the benefits of this invention. Particularly, none of the prior art known to Applicant teaches a cellulosic fibrous structure which increases caliper and provides a surface texture of a single lamina without mechanical embossing, or joining to another lamina.

Accordingly, it is an object of this invention to provide a method of increasing the caliper and surface texture of a single lamina cellulosic fibrous structure. It is an object of this invention to do so without unduly sacrificing other material properties desired by the consumer. Finally, it is an object of this invention to do so without requiring the cellulosic fibrous structure to be joined to another lamina to form a laminate.

SUMMARY OF THE INVENTION

The present invention is a macroscopically monoplanar single lamina cellulosic fibrous structure. In one embodiment the cellulosic fibrous structure comprises an essentially continuous network and first and second pluralities of discrete nonembossed protuberances dispersed in and throughout the essentially continuous network. The first plurality of protuberances extends outwardly from the plane of the lamina in a direction perpendicular to the plane of the lamina. The second plurality of protuberances also extends outwardly from the plane of the lamina in a direction perpendicular to the lamina and is oriented opposite the orientation of the first plurality of protuberances.

In a second embodiment the cellulosic fibrous structure has fluid embossed protuberances extending outwardly from the plane of the lamina. The fluid embossed protuberances are drawn into a pressure differential pervious medium by a pressure differential.

The invention also comprises a process for producing the cellulosic fibrous structures described above. The process comprises the steps of providing a single lamina parent cellulosic fibrous structure having a macroscopically monoplanar essentially continuous network. A first plurality of discrete protuberances is dispersed in and throughout this network, whereby each of these discrete protuberances extends outwardly in a first direction generally perpendicular to the plane of the lamina.

Also provided is a pressure differential pervious medium and a pressure differential across this medium. The parent cellulosic fibrous structure is disposed across the medium such that the protuberances are oriented away from the pressure differential pervious medium. The parent cellulosic fibrous structure is subjected to a pressure differential such that the protuberances are oriented towards the high pressure side of the pressure differential.

The parent cellulosic fibrous structure is transported across the pressure differential in a direction generally parallel to the plane of the cellulosic fibrous structure, so that each protuberance of a second plurality is sufficiently exposed to the pressure differential through the pressure differential pervious medium. Each protuberance of the second plurality is then invertedly biased to extend outwardly and be oriented towards the low pressure side of the pressure differential. In this manner the protuberances of the second plurality are inverted from the original orientation.

To produce the second embodiment, it is not necessary that the parent cellulosic fibrous structure have protuberances. A portion of the essentially continuous network could be exposed to the pressure differential to form protuberances.

BRIEF DESCRIPTION OF THE DRAWINGS

While the Specification concludes with claims particularly pointing out and distinctively claiming the present invention, it is believed the same will be better understood from the following description taken in conjunction with the accompanying drawings in which like parts are given the same reference numeral, analogous parts are designated with a prime symbol and:

DETAILED DESCRIPTION OF THE INVENTION

Figure 1:
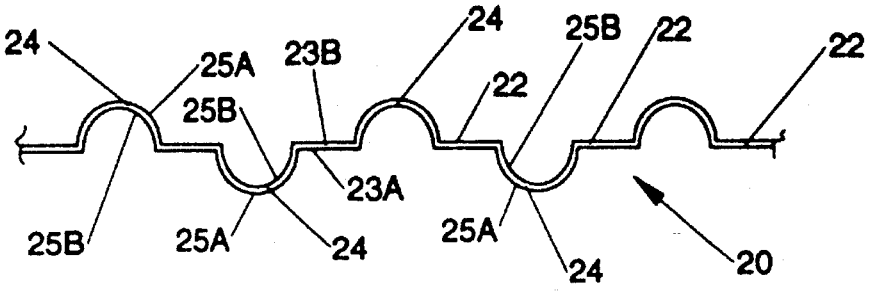
FIG. 1 is a fragmentary side elevational schematic view of a cellulosic fibrous structure having bilaterally oriented protuberances according to the present invention.

As illustrated in FIG. 1, a cellulosic fibrous structure 20 according to the present invention is macroscopically two dimensional and monoplanar, although not necessarily flat. The cellulosic fibrous structure 20 does have some thickness in the third dimension. However, the third dimension is very small compared to the two principal dimensions or the capability to manufacture a cellulosic fibrous structure 20 according to the present invention and having relatively large measurements in the two principal dimensions. By "macroscopically monoplanar," it is meant that the cellulosic fibrous structure 20 lies principally in a single, although not necessarily flat, plane, recognizing that undulations and surface topographies do exist on a microscale.

A cellulosic fibrous structure 20 according to the present invention comprises two regions. The first region is an essentially continuous network 22 which defines the plane of the cellulosic fibrous structure 20. The second region comprises discrete protuberances 24 dispersed in and throughout the essentially continuous network 22. The discrete protuberances 24 extend outwardly in both directions from and perpendicular to the plane of the cellulosic fibrous structure 20 defined by the essentially continuous network 22.

The cellulosic fibrous structure 20 is composed of cellulosic fibers approximated by linear elements. The fibers have one very large dimension (along the longitudinal axis of the fiber) compared to the other two relatively small dimensions (mutually perpendicular, and both being radial and perpendicular to the long axis of the fiber), so that linearity is approximated.

While microscopic examination of the fibers may reveal the other two dimensions which are small, compared to the principal dimension of the fibers, such other two small dimensions need not be substantially equivalent nor constant throughout the axial length of the fiber. It is only important that the fiber be able to bend about its axis, be able to bond to other fibers, and be able to be distributed by a fluid carrier. A fluid carrier is used in accordance with the present invention for both air laying and wet laying processes, although the particular process selected is not critical to the present invention.

The fibers comprising the cellulosic fibrous structure 20 may be synthetic, such as polyolefin or polyester; are preferably cellulosic, such as cotton linters, rayon, or bagasse; and more preferably are wood pulps such as softwoods (gymnosperms or coniferous) or hardwoods (angiosperms or deciduous).

As used herein a fibrous structure 20 according to the present invention is considered "cellulosic" if the fibrous structure 20 comprises at least about 50 weight percent or at least about 50 volume percent cellulosic fibers including but not limited to those fibers listed above. A cellulosic mixture of wood pulp fibers comprising softwood fibers having a length of about 1.5 to about 5.3 millimeters and a diameter of about 25 to about 50 micrometers and hardwood fibers having a length of about 0.5 to about 1.6 millimeters and a diameter of about 12 to about 25 micrometers has been found to work well for the cellulosic fibrous structures 20 described herein.

If wood pulp fibers are selected for the cellulosic fibrous structure 20, the wood pulp fibers may be produced by any pulping process including chemical processes, such as sulfite, sulfate, and soda processes; and mechanical processes, such as stone groundwood. Alternatively, the fibers may be produced by combinations of chemical and mechanical processes or may be recycled. The type, combination and processing of the fibers used are not critical to the present invention.

The cellulosic fibrous structure 20 according to the present invention comprises a single lamina. However, it is to be recognized that two or more single lamina, any or all made according to the present invention, may be Joined in face-to-face relation to form a unitary laminate. Such a laminate, having at least one lamina according to the present invention, is considered to incorporate the present invention into that lamina of the laminate.

The cellulosic fibrous structure 20 according to the present invention is considered to be a "single lamina" if it is taken off the forming element as a single sheet having a thickness prior to drying which does not change unless fibers (or other materials) are added to or removed from the sheet in the Z-direction. Although not necessary, the cellulosic fibrous structure 20 according to the present invention may later be embossed, or remain nonembossed as desired.

The region of the cellulosic fibrous structure 20 which comprises the "essentially continuous network" extends substantially throughout the cellulosic fibrous structure 20 in one or both of its principal dimensions. Regions are considered "discrete" which are not mutually contiguous, but yet are distinguishable from the essentially continuous network 22.

"Protuberances" are regions of the cellulosic fibrous structure 20 which have a Z-direction projection greater than the undulations, topographical projections and other variations indigenous to the manufacturing process. As used herein the "Z-direction" is generally perpendicular to the plane of the cellulosic fibrous structure 20 or other two dimensional structure. The "X-Y directions" are mutually perpendicular, perpendicular to the Z-direction, and within the plane of the cellulosic fibrous structure 20 or other two dimensional structure. The X-Y directions define the aforementioned dimensions of the cellulosic fibrous structure 20.

Each of the discrete protuberances 24 may be distinguished from the essentially continuous network 22 due to the discrete protuberances 24 extend outwardly from the plane of the lamina defined by the essentially continuous network 22) which comprises the cellulosic fibrous structure 20 in a first direction. As used herein, protuberances 24 are considered to "extend outwardly" from a plane when the protuberances 24 may be tactilely or visually discerned (with magnification tf needed) to have an orientation and walls which are disposed in a direction having a vector component generally perpendicular to the plane of the lamina and an extent greater than that imposed by normal variations indigenous to the manufacturing process.

The discrete protuberances 24 and the essentially continuous netscork 22 may be further mutually differentiated by an intensive property. As used herein, a property is considered "intensive" if it does not have a value dependent upon the aggregation of values within the plane of the cellulosic fibrous structure 20. Examples of intensive properties include the density, basis weight and temperature of the cellulosic fibrous structure 20.

Conversely, as used herein, properties which depend upon the aggregation of various values of subsystems or components of the cellulosic fibrous structure 20 are considered "extensive." Examples of extensive properties include the weight, mass and moles of the cellulosic fibrous structure 20.

Particularly, the discrete protuberances 24 may have a lesser basis weight or, preferably, may have a lesser density than the essentially continuous network 22. This difference in intensive property allows for easier Z-direction movement of the fibers forming the discrete protuberances 24 to occur when subjected to the process described below.

Preferably the discrete protuberances 24 are disposed in a nonrandom, repeating pattern. By being "nonrandom," the positions of the protuberances 24 within the essentially continuous network 22 are considered to be predictable and may occur as a result of known and predetermined features of the manufacturing process or the hardware used to manufacture the cellulosic fibrous structure 20. By "repeating" the pattern is formed more than once in the cellulosic fibrous structure 20. It is to be recognized the pattern may repeat, without appearing to repeat, if the size of the pattern is large compared to the size of the consumer product embodying the cellulosic fibrous structure 20 according to the present invention.

Preferably, the discrete protuberances 24 are bilaterally staggered. As used herein, protuberances 24 are considered to be "bilaterally staggered" if they are offset from the adjacent protuberances 24 in both the machine direction and cross machine direction of manufacture of the cellulosic fibrous structure 20. Preferably the nonrandom, repeating pattern tesselates, so that the discrete protuberances 24 are cooperatively and advantageously juxtaposed. However, it is to be recognized by one skilled in the art that the invention is not limited to protuberances 24 disposed in any particular pattern and Indeed includes protuberances 24 randomly dispersed in and throughout the essentially continuous network 22.

The protuberances 24 may be made in any desired shape. A particularly preferred shape is a semisphere having a generally circular perimeter at the juncture of the protuberance 24 and the essentially continuous network 22. it will be apparent to one skilled in the art that if protuberances 24 having a semispherical shape are selected, the apex of the protuberances 24 represents the furthest extent of the protuberances 24 from the plane of the cellulosic fibrous structure 20. However, the discrete protuberances 24 need not be of this shape or even of the same shape. It is only important that the discrete protuberances 24 extend outwardly from the plane of the lamina comprising the cellulosic fibrous structure 20, so that the protuberances 24 are distinguishable from the essentially continuous network 22 as described above.

The size of the protuberances 24 depends upon the ultimate use of the consumer product (toilet tissue, facial tissue, paper towels) for which the cellulosic fibrous structure 20 is intended. For example, relatively larger size protuberances 24 may be used with paper towels to facilitate scrubbing and cleaning than would be used for toilet and facial tissues. Toilet and facial tissues should generally have a smoother texture to accommodate epidermal contact without irritation.

Furthermore, the size and shape of the protuberances 24 may depend upon the basis weight of the cellulosic fibrous structure 20. Generally, as the basis weight of the cellulosic fibrous structure 20 increases, relatively larger size protuberances 24 may be utilized to reduce pinholing. Also, relatively larger sized protuberances 24 may be utilized for paper towels than for tissue products. This difference in protuberance 24 size is due to the coarser forming wire weave which can be accommodated by paper towels without causing epidermal irritation. Furthermore, larger sized protuberances 24 may increase flexibility, and hence the soft tactile sensation associated with the cellulosic fibrous structure 20, and may increase absorbency as well.

For the cellulosic fibrous structures 20 described herein, having a thickness of about 0.32 to about 0.42 millimeters (0.0125 to 0.0165 inches), the size of the protuberances 24 may vary from about 2 to about 155 protuberances 24 per square centimeter (10 to 1,000 protuberances 24 per square inch). More preferably the size of the protuberances 24 may vary from about 13 to about 110 protuberances 24 per square centimeter (83 to about 711 protuberances 24 per square inch).

Figure 2:
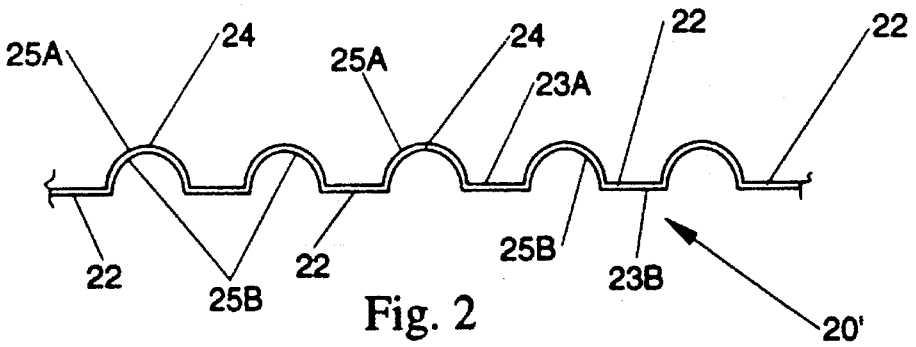
Fig. 2 Prior Art
FIG. 2 is a fragmentary side elevational schematic view of a cellulosic fibrous structure having unilaterally oriented protuberances according to the prior art.

The cellulosic fibrous structure 20 according to the present invention may be made by producing and providing a parent cellulosic fibrous structure 20' made according to the prior art, as illustrated in FIG. 2. Such a parent cellulosic fibrous structure 20' has a first plurality of discrete protuberances 24 dispersed in an essentially continuous network 22 and unilaterally extending outwardly from the plane of the lamina in the Z-direction and in the same orientation.

A parent cellulosic fibrous structure 20' having unilaterally extending protuberances 24, which are oriented from the same Z-direction, and which later becomes a cellulosic fibrous structure 20 having bilaterally outwardly extending protuberances 24 according to the present invention is herein referred to as a "parent cellulosic fibrous structure."

Outwardly extending protuberances 24 in a parent cellulosic fibrous structure 20' are considered to extend "unilaterally" if the protuberances 24 are oriented away from the plane of the parent cellulosic fibrous structure 20' in the same Z-direction, and none or only an unintended trace amount of the protuberances 24 are oppositely oriented in the Z-direction. Protuberances 24 are considered to be "bilaterally" oriented if a first plurality of the protuberances 24 extends outwardly from the plane of the cellulosic fibrous structure 20 in the Z-direction and a second plurality of the protuberances 24 extends outwardly and oppositely from the plane of the cellulosic fibrous structure 20 in the Z-direction and both pluralities constitute more than a trace amount of the total number of the protuberances 24 present as illustrated in FIG. 1. Preferably, but not necessary, both of the pluralities of the protuberances 24 approximate about 50 percent of the total number of protuberances 24 present.

Referring back to FIG. 2, there are several ways known in the art to make a suitable parent cellulosic fibrous structure 20'. For example, the parent cellulosic fibrous structure 20' may be made having an essentially continuous network 22 which is relatively low in basis weight and high in density compared to the discrete protuberances 24 which are relatively low in density and may be relatively high in basis weight. In such a parent cellulosic fibrous structure 20' the protuberances 24 will have relatively low tensile strength compared to the essentially continuous network 22.

This type of parent cellulosic fibrous structure 20' is preferred because the relatively low strength of the protuberances 24 readily allows for inversion of the protuberances 24 to occur, so that a second plurality of protuberances 24 oriented in the direction opposite the orientation of the first plurality of protuberances 24 may be formed on the parent cellulosic fibrous structure 20'.

A preferred parent cellulosic fibrous structure 20' of this type may be made and provided in accordance with the prior art. Particularly, such a parent cellulosic fibrous structure 20' may be made by providing an aqueous dispersion of cellulosic fibers and forming an embryonic web of the cellulosic fibers on a foraminous surface such as a forming wire. Particularly, a Fourdrinier wire in the form of an endless belt may be utilized for this purpose.

The embryonic web to become the parent cellulosic fibrous structure 20' is associated with a deflection member. The deflection member has one surface which contacts the embryonic web and comprises a macroscopically monoplanar essentially continuous contact surface. Within the essentially continuous contact surface is a pattern which defines a plurality of discrete isolated deflection conduits. The cellulosic fibers of the embryonic web are deflected into the deflection conduits and water removed therefrom through the deflection conduits. This procedure forms a web of papermaking fibers under conditions such that the deflection of the cellulosic fibers is initiated no later than the time at which water removal through the deflection conduits is initiated. The web formed in this manner is then dried into a parent cellulosic fibrous structure 20' and foreshortened or creped as desired.

A parent cellulosic fibrous structure 20' may be made in this manner according to the teachings of commonly assigned U.S. Pat. No. 4,529,480 issued Jul. 16, 1985 to Trokhan, which patent is incorporated herein by reference for the purpose of showing how to produce and provide a particularly preferred parent cellulosic fibrous structure 20'.

In yet another manner, the parent cellulosic fibrous structure 20' may be formed by providing a conventional sheet of tissue and embossing the first plurality of protuberances 24. The first plurality of protuberances 24 may be mechanically embossed, as is known in the prior art, or fluid embossed as described below. However, mechanical embossing is generally less preferred, due to the drawbacks noted above.

Once the parent cellulosic fibrous structure 20' has been formed by any suitable method, including methods other than those described above, the parent cellulosic fibrous structure 20' may be processed into a cellulosic fibrous structure 20 according to the present invention having bilaterally oriented protuberances 24 extending away from the plane of the cellulosic fibrous structure 20 in both directions.

Figure 3:
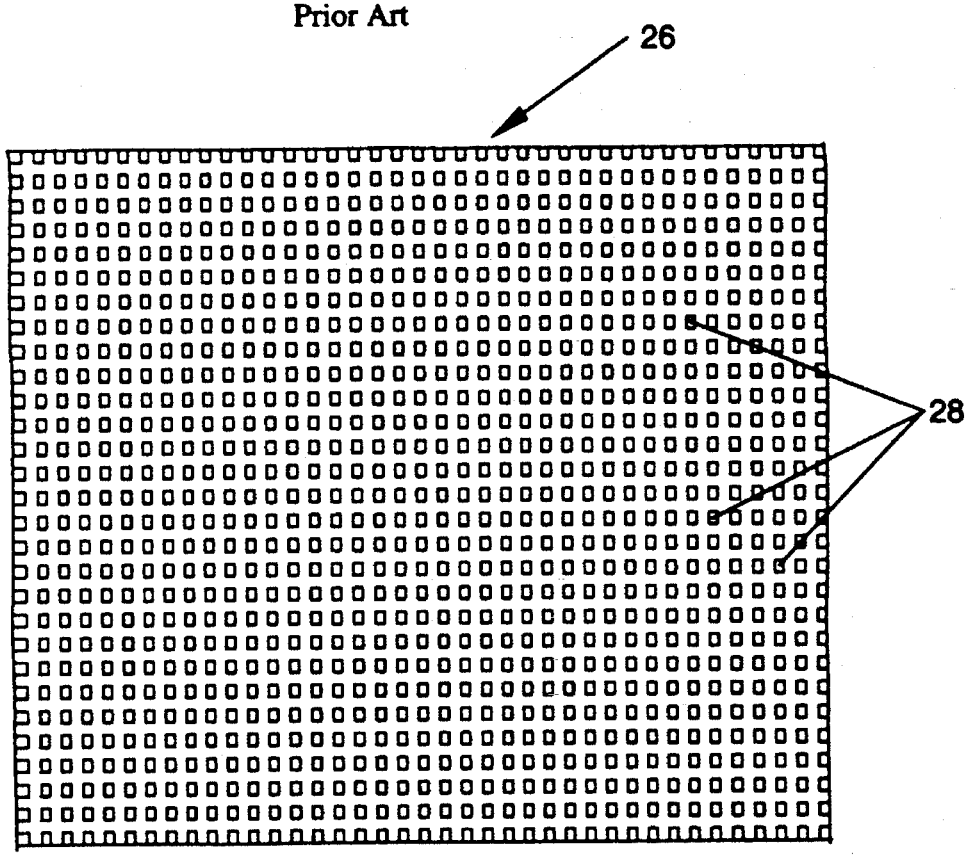
FIG. 3 is a fragmentary top plan view of a pressure differential pervious medium which can be utilized in conjunction with the cellulosic fibrous structure according to FIG. 2 to form the cellulosic fibrous structure according to FIG. 1.

In this process, a pressure differential pervious medium 26 is provided as illustrated in FIG. 3. As used herein, a "medium" is any generally two dimensional array through which a force can be transmitted having a vector component perpendicular to the plane of the medium 26. More particularly, a "pressure differential pervious" medium 26 is a medium 26 through which a difference in pressure can be transmitted, maintained, or caused to occur on opposite sides of such medium 26.

The pressure differential pervious medium 26 used in accordance with the present invention should be generally water resistant and able to accommodate a wide variety of temperatures, particularly elevated temperatures, so that the medium 26 can withstand the effects of the papermaking process described herein, or otherwise selected, used to form the cellulosic fibrous structure 20 without encountering deleterious effects itself or without imparting deleterious effects to the cellulosic fibrous structure 20 formed thereon.

A particularly preferred material for the pressure differential pervious medium 26 is a stiff plastic, such as a nylon, a polyolefin, or preferably a photosensitive polymeric resin. Such a material may be made rigid enough to accommodate the pressure differentials described hereunder without significant deflection, yet not encounter deleterious effects or impart deleterious effects to the cellulosic fibrous structure 20.

The pressure differential pervious medium 26 has a plurality of apertures 28 therethrough, so that the pressure differential may be transmitted, maintained, or caused to occur from one side of the pressure differential pervious medium 26 to the other. The apertures 28 transfer the pressure differential through the pervious medium 26 in the Z-direction.

The size of the apertures 28 is dependent upon the size of the discrete protuberances 24 in the parent cellulosic fibrous structure 20'. Generally, it is desired that the apertures 28 be approximately 1.1 times to approximately 2.0 times larger in a linear dimension than the discrete protuberances 24 in the parent cellulosic fibrous structure 20', with a size of about 1.4 times larger to about 1.6 times larger than the discrete protuberances 24 being more preferred, and a size about 1.5 times larger than the discrete protuberances 24 being most preferred. Preferably, but not necessarily, the apertures 28 are mutually equally sized and generally matched to the shape of the protuberances 24.

If larger sized apertures 28 (relative to the discrete protuberances 24) than described above are utilized, deflection of multiple protuberances 24 and/or the essentially continuous network 22 into the apertures 28 may result and the resulting cellulosic fibrous structure 20 have an undesirable hand and/or appearance. Furthermore, apertures 28 which are too large may result in inversion of too many of the first plurality of unilaterally extending protuberances 24, causing most, if not all, to become inverted and extend outwardly from the plane of the cellulosic fibrous structure 20 in the second and opposite direction. This arrangement is undesirable because the protuberances 24 of the resulting cellulosic fibrous structure 20 will still be essentially unilaterally oriented, in that most, if not all, of the protuberances 24 extend outwardly in the same direction and the benefits of the present invention may not be recognized.

Conversely, if smaller sized apertures 28 (relative to the discrete protuberances 24) than described above are utilized, only partial inversion of a protuberance 24, near its center or apex, may occur. This arrangement may yield a reentrant protuberance 24 extending outwardly from the plane of the cellulosic fibrous structure 20 in the second direction as well as the first direction, but not extending sufficiently (in either direction) to obtain the full caliper and/or texture benefits possible with the present invention. Or, this arrangement may yield a new protuberance 24, fluidly embossed through the smaller sized aperture 28.

The principal X-Y dimensions of the pressure differential pervious medium 26 may be of any size large enough to accommodate the X-Y dimensions of the cellulosic fibrous structure 20 to be formed. However, it is to be recognized that only a portion of a parent cellulosic fibrous structure 20' may be treated according to the present invention, to yield a cellulosic fibrous structure 20 as described and claimed hereunder, leaving the balance of the parent cellulosic fibrous structure 20' according to the teachings of the prior art. Generally, it is desired that the width of the pressure differential pervious medium 26 be slightly greater than the width of the parent cellulosic fibrous structure 20', so that a cellulosic fibrous structure 20 according to the present invention may be entirely formed and cross machine direction tracking variations readily accommodated.

The length of the pressure differential pervious medium 26, as taken in the machine direction, should be sufficient to accommodate the desired number of apertures 28, depending upon the residence time of the parent cellulosic fibrous structure 20' on the pressure differential pervious medium 26, and should be as long as necessary to accommodate an endless belt if the pressure differential pervious medium 26 moves with the parent cellulosic fibrous structure 20'. Generally, for a parent cellulosic fibrous structure 20' moving with the pressure differential pervious medium 26 at a rate of about 1,220 meters per minute (4,000 feet per minute), an exposure window (such as a vacuum slot) for the pressure differential of about 0.32 centimeters (0.125 inches) in the machine direction is sufficient. It is to be recognized that if the pressure differential is relatively low, an exposure window relatively longer in the machine direction may be necessary to allow sufficient exposure of the protuberances 24 to the pressure differential, for inversion to occur.

The thickness of the pressure differential pervious medium 26, like the size of the apertures 28 therethrough, is governed by the parent cellulosic fibrous structure 20'. Particularly, the thickness of the pressure differential pervious medium 26 should be at least as great as the thickness of the parent cellulosic fibrous structure 20', and particularly at least as great as the thickness of the discrete protuberances 24 dispersed therein. If a pressure differential pervious medium 26 of lesser thickness than that of the parent cellulosic fibrous structure 20' is utilized, the protuberances 24 to be inverted may bottom out, and not obtain the full possible Z-direction extent in the second direction. For the embodiments described herein, a pressure differential pervious medium 26 having a thickness of about 0.76 to about 2.54 millimeters (0.030 to 0.100 inches) has been found to work well.

To invert the discrete unilaterally oriented protuberances 24, the parent cellulosic fibrous structure 20' is disposed across the pressure differential pervious medium 26 and preferably is disposed in contacting relationship therewith. The parent cellulosic fibrous structure 20' is disposed so that the protuberances 24 are oriented toward the high pressure side of the pressure differential and away from the pressure differential pervious medium 26. The parent cellulosic fibrous structure 20' is then transported with or across the differential pervious medium 26 in a direction generally parallel to the plane of the cellulosic fibrous structure 20 while the pressure differential is applied.

It is strongly preferred that the pressure differential pervious medium move with the parent cellulosic fibrous structure 20' so there is no relative movement therebetween. This arrangement accommodates higher speed operation according to the process of the present invention without tearing the parent cellulosic fibrous structure 20'. Prophetically, it is not important whether the pressure differential pervious medium 26 is moving or stationary if the parent cellulosic fibrous structure 20' is only exposed to relatively low draw tensions.

Regardless of the selected arrangement, it is only important that the parent cellulosic fibrous structure 20' move relative to the applied pressure. In this manner the exposure time of the parent cellulosic fibrous structure 20' to the pressure differential can be carefully controlled or adjusted as desired.

The pressure differential is preferably a fluid pressure differential, rather than a mechanically applied compressive force—such as occurs by embossing or imprinting a knuckle pattern onto a cellulosic fibrous structure 20. A fluid pressure which yields the aforementioned pressure differential may be accomplished by providing on the high pressure side of the parent cellulosic fibrous structure 20' a fluid pressure which is greater than the atmospheric (or other ambient) pressure on the low pressure side of the parent cellulosic fibrous structure 20'. Alternatively, the pressure differential is preferably applied by drawing a vacuum through the apertures 28 of the pressure differential pervious medium 26 so that a subatmospheric pressure is provided on the low pressure side of the parent cellulosic fibrous structure 20'.

When the outwardly extending protuberances 24 are coincident with an aperture 28 of the pressure differential pervious medium 26 or otherwise sufficiently exposed to the pressure differential, the pressure differential will act on the coincident protuberances 24 to invert such protuberances 24. When inverted, the protuberances 24 are oriented opposite their original direction and extend outwardly, in the second direction, towards the low pressure side of the pressure differential and towards the differential pervious medium 26.

The amount of pressure differential applied to the parent cellulosic fibrous structure 20' is important in obtaining a cellulosic fibrous structure 20 according to the present invention. As recorded in many well known treatises on static load applications, the Z-direction deflection of a protuberance 24 is proportional to the cube of the span of the protuberance and to the applied pressure differential. Similarly, the Z-direction deflection of a protuberance is inversely proportional to the cube of the thickness of the protuberance 24 and to the tensile modulus of the material. For the embodiments described herein, a pressure of about 12.7 to about 25.4 centimeters of Mercury (5 to 10 inches of Mercury) at an air flow rate through the parent cellulosic fibrous structure 20' of about 0.82 to about 1.02 cubic meters per minute (29 to 36 cubic feet per minute) per 3.2 square centimeters (0.500 square inches) has been found to work well.

Another and second very important factor in achieving a cellulosic fibrous structure 20 according to the present invention is the application of heat to the parent cellulosic fibrous structure 20' while, and/or before, it is exposed to the pressure differential. Particularly, it is important that the cellulosic fibers comprising the parent cellulosic fibrous structure 20' be heated above the glass transition temperature. This elevated temperature assures that after the coincident protuberances 24 are inverted, the inverted protuberances remain in the second outwardly oriented direction and do not revert to the original orientation.

The glass transition temperature is dependent upon the amount of water left in the parent cellulosic fibrous structure 20' after any predrying occurs. The glass transition temperature for a particular parent cellulosic fibrous structure 20' may be found in accordance with the teachings of several well-known treatises, including "The Influence of Water on the Glass Transition Temperature of Cellulose" by Salmen and Back, published in *Fibre-Water Interactions in Paper-Making*, vol. 2 1978, which treatise is incorporated herein by reference for the purpose of showing how to ascertain the glass transition temperature of cellulosic fibers. Generally, for the embodiments described herein the parent cellulosic fibrous structure 20' should be heated to at least about 66° C. (150° F.) so that any inversion of coincident protuberances 24 due to the pressure differential results in two permanent bilaterally oriented pluralities of protuberances 24.

A third factor affecting the process is the addition of emollient to the parent cellulosic fibrous structure 20'. The emollient generally reduces the amount of pressure differential necessary to invert the discrete protuberances 24 and assists in permanently maintaining the orientation of coincident protuberances 24 in extending outwardly in the second direction. Cellulosic fibrous structures 20 having an emollient may be made in accordance with the teachings of commonly assigned U.S. Pat. Nos. 4,513,051 issued Apr. 23, 1985 to Lavash and 4,481,243 issued Nov. 6, 1984 to Allen, which patents are incorporated herein by reference for the purpose of showing how to treat a cellulosic fibrous structure 20 with emollient.

A fourth factor affecting the process of producing a cellulosic fibrous structure 20 according to the present invention is the period of time during which the pressure differential is applied to the parent cellulosic fibrous structure 20'. Generally, the period of time during which the parent cellulosic fibrous structure 20' is exposed to the pressure differential is a less critical factor than the amount of the pressure differential, the air flow rate, or whether (and how much) heat (or emollient) is applied to the parent cellulosic fibrous structure 20'. However, as noted above, the exposure time may become a more important factor at relatively lower pressure differentials or relatively lower air flow rates.

Preferably, the parent cellulosic fibrous structure 20' is held under tension while on the pressure differential pervious medium 26 and the pressure differential is applied. This tension is a fifth factor which is not critical, but may be effected by any means well known in the art, such as having a winding roll run at a slightly higher peripheral velocity than the unwind roll from which the parent cellulosic fibrous structure 20' is supplied.

Figure 4:
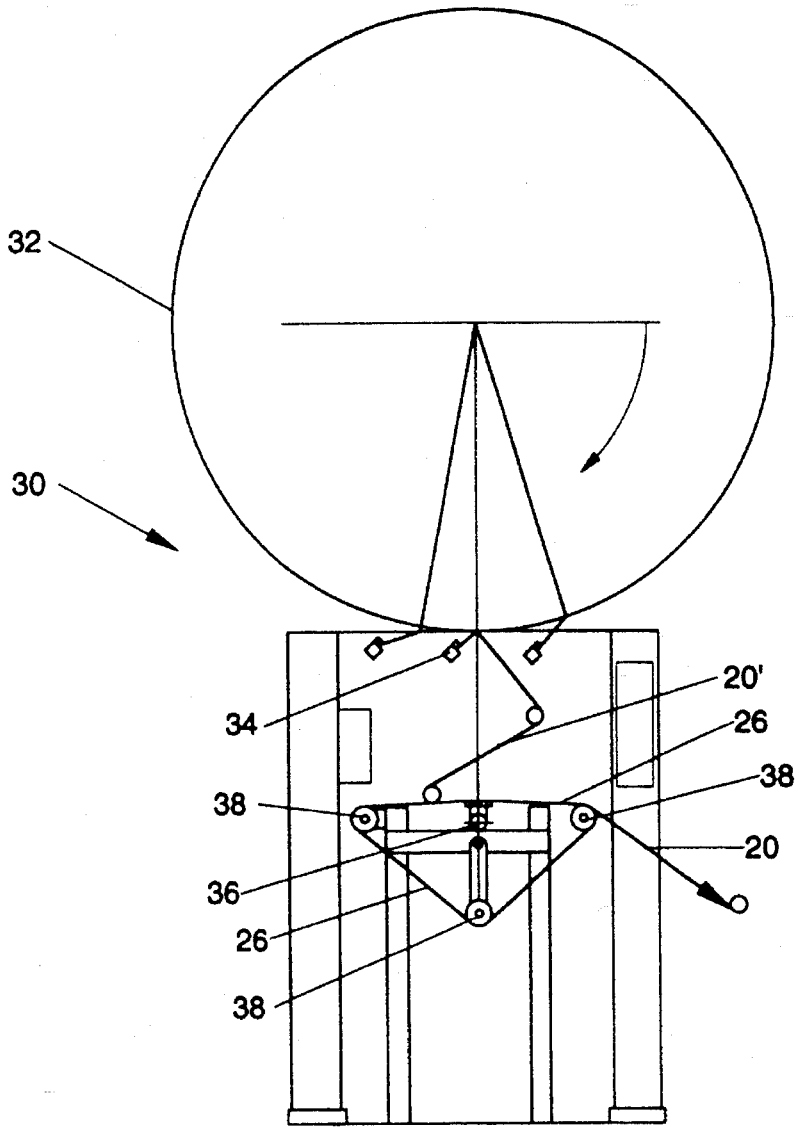
FIG. 4 is a schematic vertical elevational view of one apparatus which may be used to produce a cellulosic fibrous structure according to the present invention, and particularly having a pressure differential pervious medium which moves with the cellulosic fibrous structure relative to the pressure differential.

Referring to FIG. 4, prophetically an apparatus 30 utilized to make a cellulosic fibrous structure 20 according to the present invention may be advantageously incorporated into a papermaking machine as is otherwise currently known in the art. One advantageous location to install the pressure differential pervious medium 26 is intermediate a Yankee drying drum 32 and the equipment utilized for subsequent converting operations. By applying the pressure differential close in time and distance to the Yankee drying drum 32, the parent cellulosic fibrous structure 20' may easily be heated above the glass transition temperature of the cellulosic fibers without requiring a separate and expensive heating operation. This usage of existing heat assures permanent inversion of the protuberances 24 coincident with the apertures 28 can be readily achieved as described above.

The parent cellulosic fibrous structure 20' is removed from the Yankee drying drum 32 by a doctor blade 34 which crepes and foreshortens the parent cellulosic fibrous structure 20'. The parent cellulosic fibrous structure 20' is then transferred to the pressure differential pervious medium 26.

The pressure differential pervious medium 26 may be in the form of an endless belt disposed on a track driven by one or more wheels 38. Using this arrangement, the parent cellulosic fibrous structure 20' is superimposed on the pressure differential pervious medium 26 and both are moved relative to the applied pressure differential without substantial relative movement between the parent cellulosic fibrous structure 20' and the pressure differential pervious medium 26.

The pressure differential pervious medium 26 and cellulosic fibrous structure 20 are transported over a vacuum box 36 disposed on the side of the pressure differential pervious medium 26 opposite the parent cellulosic fibrous structure 20'. The vacuum box 36 is stationary and applies a predetermined pressure differential for a period of time depending upon the rate of the movement of the pressure differential pervious medium 26 relative to the vacuum box 36. The vacuum is the pressure differential which inverts the orientation of a second plurality of the discrete protuberances 24. After transporting the cellulosic fibrous structure 20 across the vacuum box 36, the cellulosic fibrous structure 20 is removed from the pressure differential pervious medium 26 and wound onto a roll or subsequently converted as desired.

EXAMPLE

Several nonlimiting laboratory bench scale tests were run at different amounts of pressure differential, particularly at various amounts of vacuum, on toilet tissue made by The Procter & Gamble Company of Cincinnati, Ohio according to commonly assigned U.S. Pat. No. 4,529,480 issued Jul. 16, 1985 to Trokhan.

The toilet tissue utilized for this test had approximately 87 protuberances 24 per square centimeter (562 protuberances 24 per square inch), a basis weight of about 30.1 grams per square meter (18.5 pounds per 3000 square feet), a caliper of about 0.32 millimeters (0.0125 inches) and comprised about 25 percent Northern softwood kraft fibers and about 75 percent hardwood fibers.

The pressure differential pervious medium 26 moved with the parent cellulosic fibrous structure 20' and was a portion of a drying belt. The drying belt selected for the pressure differential pervious medium was double cast to provide a sandwich construction having a dual filament secondary support lamina between two photopolymer laminate, and otherwise made according to commonly assigned U.S. Pat. No. 4,514,345 issued Apr. 30, 1985 to Johnson et al., which patent is incorporated herein by reference for the purpose of showing how to make a suitable pressure differential pervious medium 26.

The photopolymer lamina contacting the parent cellulosic fibrous structure 20' has a thickness of about 0.17 centimeters (0.067 inches) and about 47 apertures 28 per square centimeter (300 apertures 28 per square inch). The central secondary support lamina has a thickness of about 0.46 millimeters and provided support for the inverted protuberances 24, to prevent excessive deflection in the Z-direction. The other photopolymer lamina has a thickness of about 0.25 millimeters and provided a vacuum seal against the applied pressure differential.

This combination of parent cellulosic fibrous structure 20' and pressure differential pervious medium 26 provided a linear frequency of apertures 28 about 1.37 times that of the protuberances 24 as given by the formula:

$$\{(562 \text{ protuberances/sq. in.})/(300 \text{ apertures/sq. in.})\}^{1/2}.$$

The airflow through the pressure differential pervious medium 26 (with the parent cellulosic fibrous structure 20' superimposed thereon) was estimated to be 0.82 to 1.02 cubic meters per minute (29 to 36 cubic feet per minute) per 3.2 square centimeters (0.5 square inches) at pressure differentials of about 12.7 to about 25.4 centimeters of Mercury (5 to 10 inches of Mercury).

It is noted that other trials using otherwise similar pressure differential pervious media 26 having 87 apertures 28 per square centimeter (562 centimeters per square inch), 39 apertures 28 per square centimeter (250 apertures 28 per square inch), and coatset sizes of apertures 28 were conducted—but produced less satisfactory results than the pressure differential pervious medium 26 described hereinabove. Particularly, when coarser apertured pressure differential pervious media 26 were utilized, Frequently the protuberance 24 and a portion of the surrounding essentially continuous network 22 would be drawn into the aperture 28 without inverting the protuberance 24.

Before exposing the parent cellulosic fibrous structure 20' to the pressure differential, convective heat was supplied from a handheld heating gun to the parent cellulosic fibrous structure 20'. As noted above, the heat was to assure the inverted protuberances 24 maintained their second orientation.

The pressure differential was supplied to the pressure differential pervious media 26 and the parent cellulosic fibrous structure 20' through a vacuum slot. The vacuum slot utilized for this example was generally rectangular and measured about 0.32 centimeters (0.125 inches) in the machine direction by about 10.2 centimeters (4 inches) in the cross machine direction. As noted above, the pressure differential pervious medium 26 and the parent cellulosic fibrous structure 20' did not move relative to one another during the test and were transported across the aforementioned vacuum slot so that each coincident protuberance 24 was exposed to the pressure differential for only a very brief period.

Figure 5:
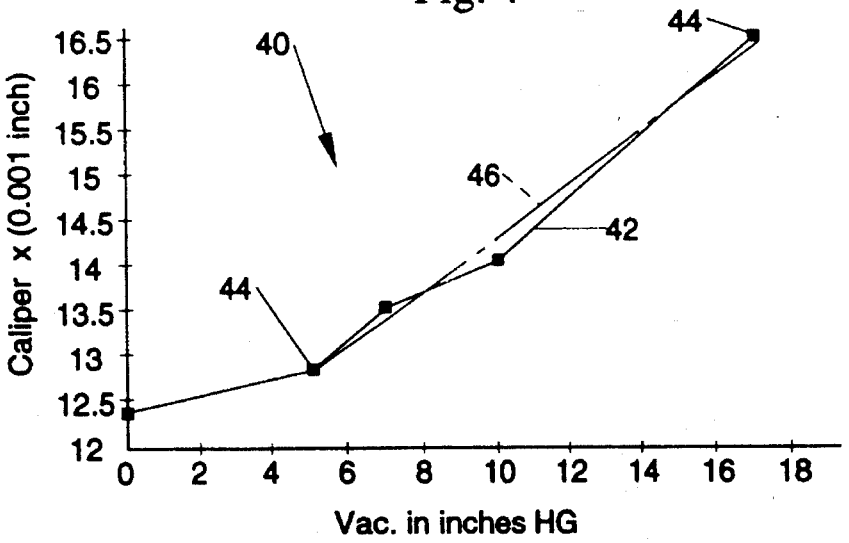
FIG. 5 is a graphical representation of the effect of various applied pressure differentials on the caliper of toilet tissue made according to the present invention.

Referring to FIG. 5, the resulting graph 40, particularly, the line 42 connecting the data points 44, illustrates the difference in caliper as a result of various amounts of pressure differential. Particularly, vacuums in the amount of 0.0 (control), 12.7, 17.8, 25.4, and 43.2 centimeters of Mercury (0.0, 5.0, 7.0, 10.0, and 17.0 inches of Mercury) were utilized to evaluate the effect of various amounts of pressure differential. Importantly, as illustrated by the curve fit line 46, a generally linear relationship exists between the increase in caliper when the cellulosic fibrous structure 20 is exposed to pressure differentials in amounts of from about 12.7 to about 43.2 centimeters of Mercury (5 to 17 inches of Mercury).

Generally the cellulosic fibrous structures 20, resulting from the exposure to the pressure differentials, exhibited no change (from the control) in the sheet modulus, as measured by ASTM D828-60. However, these samples did exhibit a reduction in tensile strength and elongation of about zero to about 30 percent as measured by TAPPI Std. T-404-OM-87. However, such reductions in tensile strength and elongation did not linearly correlate to the amount of pressure differential applied. These reductions seemed to increase as the cellulosic fibrous structure 20 encountered increased handling during the course of the testing.

Generally, the cellulosic fibrous structures 20 exposed to the pressure differential visually exhibited a subjective improvement in opacity and pinholing, which improvements are likely related to the increases in caliper and texture. Also, the cellulosic fibrous structures 20 exposed to the pressure differentials exhibited an approximately 10 percent less flexural rigidity than the control and 31 percent less bending modulus than the control as measured by ASTM B1388-64.

It was noted that the sample exposed to 43.2 centimeters of Mercury (17 inches of Mercury) visually appeared to be embossed, rather than a nonembossed, high caliper tissue consumer product. Thus, it was generally judged that for the samples run according to these conditions, a pressure differential of approximately 25.4 centimeters of Mercury (10 inches of Mercury) was optimum.

In a first variation, the process according to the present invention may be utilized to fluid emboss a cellulosic fibrous structure according to the prior art. As used herein, "fluid embossing" refers to a process wherein a pressure differential is applied through a pressure differential pervious medium 26 to a parent cellulosic fibrous structure 20' not having protuberances. Portions of the parent cellulosic fibrous structure 20' are sufficiently exposed to the pressure differential and deflected into the vacuum pervious medium 26 to extend outwardly and towards the low pressure side of the pressure differential. The pressure differential deflects the sufficiently exposed sites of the parent cellulosic fibrous structure into any desired pattern.

The fluid embossing process may be performed to yield any desired pattern in the resulting cellulosic fibrous structure, and is not limited to forming protuberances of any particular shape. If desired, two laminate, superimposed in face to face relation may be fluid embossed as described herein to assure registration of the desired pattern.

The fluid embossing process has the advantage over mechanical embossing processes according to the prior art that the aforementioned drawback of disrupting fiber to fiber bonds is reduced, minimizing or eliminating losses in tensile strength and softness. Another advantage of fluid embossing over mechanical embossing is that expensive embossing rolls are not necessary.

A parent cellulosic fibrous structure 20' suitable for fluid embossing may be of constant basis weight and density or may be made by forming a parent cellulosic fibrous structure 20' on conventional equipment using a known foraminous forming element, such as a forming wire. The parent cellulosic fibrous structure 20' is thermally predried to a particular consistency. Then, importantly, a knuckle pattern comprising, if desired, warp and weft crossover points of a selected imprinting fabric is impressed onto the parent cellulosic fibrous structure 20'. The knuckle imprint of the fabric may be impressed on the thermally predried cellulosic parent fibrous structure 20' by any means of applying mechanical pressure. The impression should be made prior to completely drying the parent cellulosic fibrous structure 20' and prior to carrying out any post forming operations, such as creping. Finally, the imprinted parent cellulosic fibrous structure 20' is completely dried.

The knuckle imprint may be carried out using an impression roll supporting the imprinting fabric and the predried parent cellulosic fibrous structure 20' against the face of a Yankee drying drum 32 which is later used to complete the drying. Alternatively, the parent cellulosic fibrous structure 20' may be molded against the imprinting fabric by fluid pressure.

A parent cellulosic fibrous structure 20' made in this manner has generally constant basis weight, a low density essentially continuous network 22 and discrete high density sites. Generally, the high density sites do not deflect sufficiently in the Z-direction to form protuberances 24, even when exposed to the pressure differential. A parent cellulosic fibrous structure 20' having a low density essentially continuous network 22 from which discrete protuberances 24 are formed from discrete high density sites may be made according to the teachings of commonly assigned U.S. Pat. No. 3,301,746 issued Jan. 31, 1967 to Sanford et al., which patent is incorporated herein by reference for the purpose of showing a feasible way to produce and provide a parent cellulosic fibrous structure 20' suitable for fluid embossing and having a low density essentially continuous network 22.

Generally fluid embossing requires a greater pressure differential to form protuberances 24 than is required to invert selected protuberances 24 according to the first embodiment. For the embodiments described herein, to fluid emboss protuberances 24 of the size listed in Example I, a pressure differential in the range of about 25.4 to about 50.7 centimeters of Mercury (10 to 20 inches of Mercury) has been found to work well.

What is claimed is:

1. A process for producing a cellulosic fibrous structure, said process comprising the steps of:

providing a single lamina parent cellulosic fibrous structure having a macroscopically monoplanar essentially continuous network and discrete protuberances dispersed therein, whereby said discrete protuberances having an original orientation extending outwardly from the plane of said essentially continuous network in a first direction generally perpendicular the plane of said lamina;

providing a pressure differential pervious medium;

providing a pressure differential across said medium;

disposing said cellulosic fibrous structure across said medium with the outwardly extending protuberances oriented away from said medium;

subjecting said cellulosic fibrous structure to said pressure differential, so that said protuberances are oriented towards a high pressure side of said pressure differential and away from said medium; and transporting said cellulosic fibrous structure across said pressure differential in a direction generally parallel to the plane of said cellulosic fibrous structure, whereby each of said protuberances sufficiently exposed to said pressure differential through said medium is biased to reverse the orientation of said protuberances, whereby the reversed protuberances extend outwardly from the plane of said essentially continuous network opposite the original orientation.

2. The process according to claim 1 wherein said step of providing a pressure differential across said medium comprises drawing a vacuum through said medium.

3. The process according to claim 2 wherein said pressure differential is about 12.7 to about 25.4 centimeters of Mercury at an air flow rate of about 0.82 to about 1.02 cubic meters per minute per 3.2 square centimeters.

4. The process according to claim 1 further comprising the steps of:

providing a source of heat; and heating said cellulosic fibrous structure prior to or while subjecting said cellulosic fibrous structure to said pressure differential.

5. The process according to claim 4 wherein said step of heating said cellulosic fibrous structure comprises heating said cellulosic fibrous structure to a temperature greater than the glass transition temperature of cellulosic fibers within said cellulosic fibrous structure.

6. The process according to claim 4 further comprising the steps of:

providing a means to tension said cellulosic fibrous structure while subjected to said pressure differential; and holding said cellulosic fibrous structure under tension while subjected to said pressure differential.

7. The process according to claim 1 wherein said essentially continuous network has a particular thickness and wherein said step of providing a pressure differential pervious medium comprises the step of providing a pressure differential pervious medium having a thickness at least as great as said particular thickness of said cellulosic fibrous structure.

8. The process according to claim 1 wherein said cellulosic fibrous structure is superimposed on said medium, and said cellulosic fibrous structure and said medium are moved relative to said pressure differential without substantial relative movement between said cellulosic fibrous structure and said medium.

9. The process according to claim 8 wherein said medium is an endless belt.

10. A process for producing a cellulosic fibrous structure, said process comprising the steps of:

providing a single lamina parent cellulosic fibrous structure having a macroscopically monoplanar essentially continuous network and discrete protuberances dispersed therein;

providing a pressure differential pervious medium;

providing a pressure differential across said pressure differential pervious medium;

disposing said parent cellulosic fibrous structure having discrete protuberances across said pressure differential pervious medium, said parent cellulosic fibrous structure having said discrete protuberances prior to being disposed across said pressure differential pervious medium;

subjecting said parent cellulosic fibrous structure having discrete protuberances to said pressure differential;

drawing discrete portions of said parent cellulosic fibrous structure having discrete protuberances into said pressure differential pervious medium wherein the step of drawing discrete portions of said parent cellulosic fibrous structure having discrete protuberances into said pressure differential pervious medium comprises inverting at least some of said discrete protuberance thereby producing said cellulosic fibrous structure; and removing said cellulosic fibrous structure from said pressure differential.

11. A process according to claim 10 further comprising the steps of:

providing a source of heat; and heating said parent cellulosic fibrous structure having discrete protuberances prior to or while subjecting said parent cellulosic fibrous structure having discrete protuberances to said pressure differential.

12. A process according to claim 11 wherein said step of heating said parent cellulosic fibrous structure having discrete protuberances comprises heating said parent cellulosic fibrous structure having discrete protuberances to a temperature greater than the glass transition temperature of cellulosic fibers within said parent cellulosic fibrous structure having discrete protuberances.

* * * * *